US005104510A

United States Patent [19]

Moehle

[11] Patent Number: 5,104,510

[45] Date of Patent: Apr. 14, 1992

[54] PLATING SYSTEM

[75] Inventor: Paul R. Moehle, Scekonk, Mass.

[73] Assignee: Texas Instruments Incorporated, Dallas, Tex.

[21] Appl. No.: 481,524

[22] Filed: Feb. 16, 1990

[51] Int. Cl.[5] ..... C25D 17/00

[52] U.S. Cl. ..... 204/206; 204/224 R

[58] Field of Search ..... 204/206, 224 R

[56] References Cited

U.S. PATENT DOCUMENTS 3,539,490 11/1970 Gannoe ..... 204/224 R 3,819,502 6/1974 Meuldijk ..... 204/206

FOREIGN PATENT DOCUMENTS 286594 11/1988 Japan .

*Primary Examiner*—T. M. Tufariello

*Attorney, Agent, or Firm*—B. Peter Barndt; Richard Donaldson; William E. Hiller

[57] ABSTRACT

An enclosed plating wheel system includes a fixed mounted shaft, feed and return spargers mounted on the shaft, and a plating wheel rotates around the fixed mounted spargers as a result of a lead frame strip being pulled around the plating wheel. A belt is also rotated around a portion of the plating wheel assembly over the lead frame strip to contain the plating solution within the plating wheel assembly.

12 Claims, 2 Drawing Sheets

PLATING SYSTEM

FIELD OF THE INVENTION

This invention relates to plating systems, and more particularly to a continuous masking electrolytic plating system.

BACKGROUND OF THE INVENTION

Prior art continuous plating systems present problems wherein unwanted electrolytic plating results outside of the desired plating area caused by the splashing of plating solution, particularly in the areas where the material to be plated enters and exits the plating chamber. Continuous plating is necessary in plating continuous strips of material such as lead frames used in semiconductor production. The lead frames are usually punched from continuous metal strips and separated at a later time, for example, after a semiconductor device has been mounted on the lead frame, and the mounted devices are separated for individual encapsulation. For this reason it is desirable to be able to plate selected areas of the lead frames prior to separation.

Burning, due to uncontrolled flow of the plating fluid also results, and fumes caused by the splashing of solution can be hazardous.

SUMMARY OF THE INVENTION

The invention is a plating system for processing continuous strips of material such as lead frames for semiconductor devices. A plating solution and current system is constructed to be placed in a second system that traps all or most of the electroplating solution after it has been used.

A first sparger encloses a second sparger system which keeps plating solution off the incoming and exiting lead frame strip, and provides an exit for the plating solution. a mask wheel is constructed to fit over and rotate around the sparger, minimizing the amount of solution spraying outside of the system. Because the plating solution is contained, and is adjustable in pressure, spot burning is reduced and plating speed increased.

The mask wheel and sparger anode is supported on a single center shaft. The plating wheel is supported and contained on both sides by wheel plates and bearings.

Plating solution enters and exits through two separate flow passages in a mounting shaft. A feed sparger applies the plating solution on to the surface of the masked lead frame, and a return sparger, which fits around the feed sparger, collects the used plating solution and removes it from a plating wheel assembly through and exit tube in the mounting shaft.

A belt is placed over the plating wheel to prevent plating solution from spraying through the lead frame and out of the plating wheel assembly.

The technical advance represented by the invention as well as the objects thereof will become apparent from the following description of a preferred embodiment of the invention when considered in conjunction with the accompanying drawings, and the novel features set forth in the appended claims.

DESCRIPTION OF A PREFERRED EMBODIMENT

Figure 1:
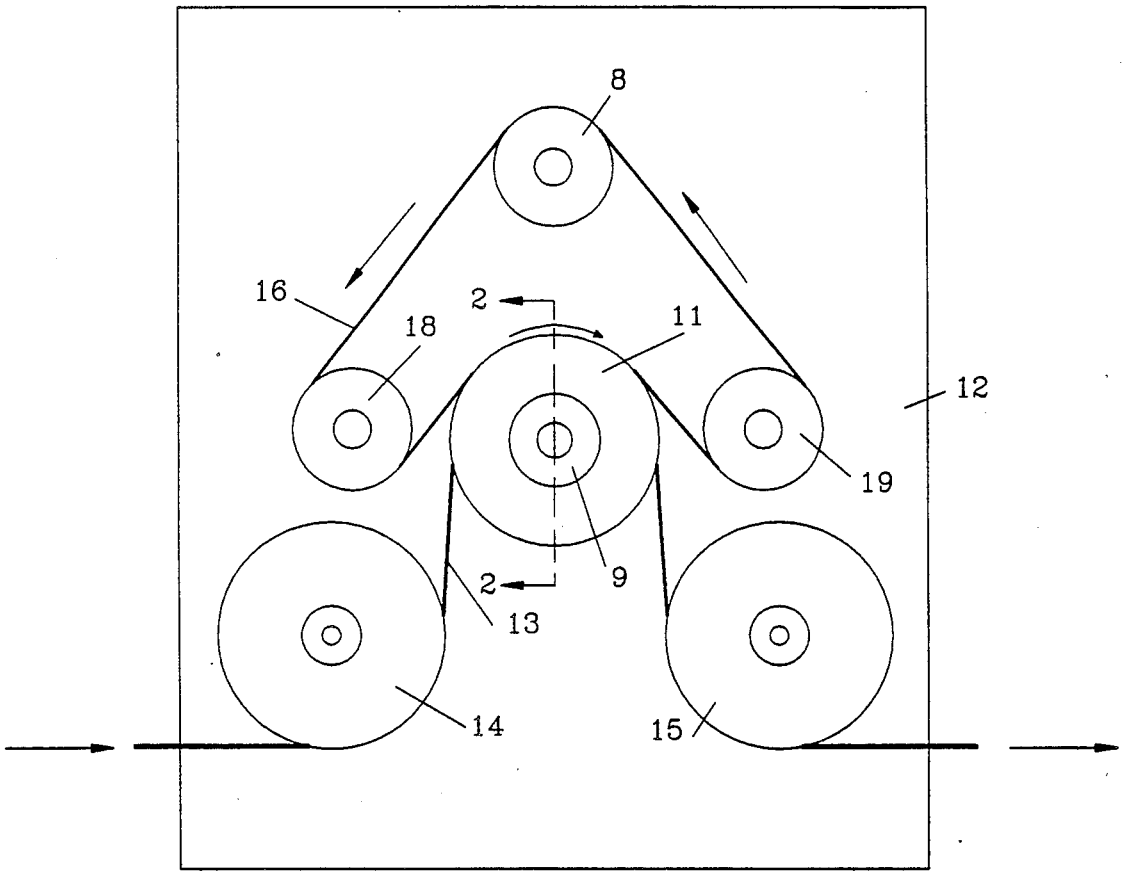
FIG. 1 Illustrates the plating system of the present invention.

FIG. 1 illustrates plating system of the present invention. A plating system wheel assembly 11 is mounted on a stationary sparger shaft 9 affixed to a vertical mounting plate 12. Sparger shaft 9 has fluid passages therein which are used to supply plating solution to the plating wheel assembly, and for removing the used plating solution from the plating wheel assembly. Shaft 9 also has a stainless steel rod therein for carrying D.C. current.

Plating solution is supplied to the fluid passage in the stationary shaft 9 from the back side of mounting plate 12. The plating solution may be supplied under controlled pressure to regulate the flow of plating solution.

A continuous strip of lead frames 13 for semiconductor devices is threaded around an idler pulley 14, plating wheel assembly 11, and idler pulley 15. The lead frame strip originates from a roll of lead frame material (not illustrated) and is rewound on a take-up reel (not illustrated). The take-up reel may be power driven, and the rotation of the take-up reel pulling the lead frame strip rotates the plating wheel as the lead frame strip is pulled around the plating wheel.

A belt system is used to contain the plating solution within the plating system. Belt 16 is threaded around idler pulleys 8, 18, and 19. In between idler pulleys 18 and 19, belt 16 is threaded over the top of plating wheel 11, and is held against the top side of lead frame strip 16. Tension may be controlled by adjusting one or more of the idler pulleys to obtain the desired tension in belt 16 and to hold it in contact with plating wheel 30, described below, and to seal the plating fluid within the plating wheel. Alternatively, idler pulley may be mounted on a pivotal shaft with a weight on one end of the shaft to bias pulley in an upward direction, applying tension to belt 16.

Figure 2:
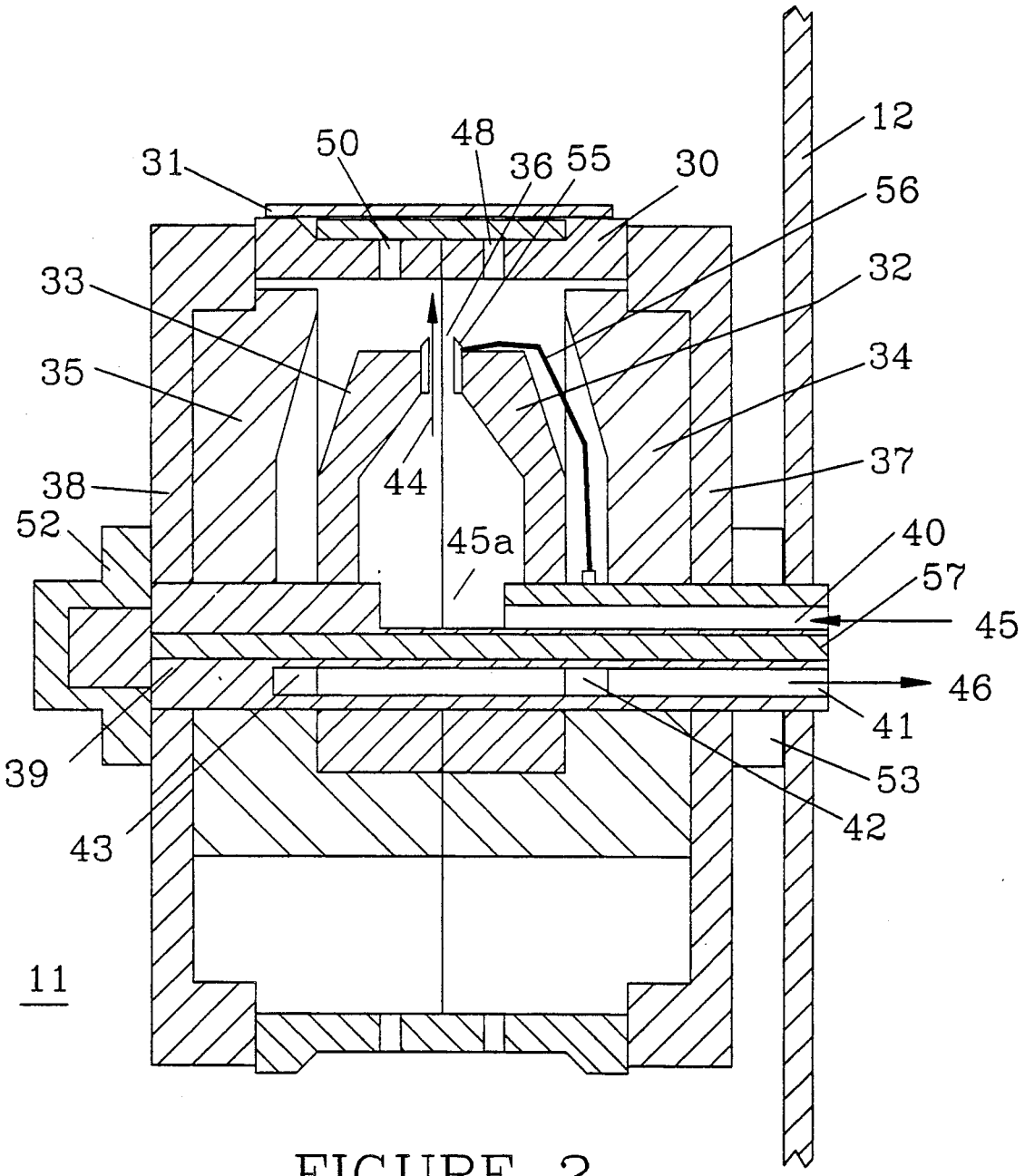
FIG. 2 is a cross-sectional view of the plating wheel assembly used in the plating system.

FIG. 2 is a cross-sectional view of plating system wheel 11, FIG. 1, taken through section 2—2. The plating system wheel is made up basically of a feed sparger 32 and 33, a return sparger 33 and 35, a plating wheel 30, two wheel plates 37 and 38, steel shaft 57 and sparger shaft 39.

The feed sparger is made up of two halves 32 and 33, and anode 55. The two halves are mounted on sparger shaft 39. Shaft 39 is rigidly secured to back plate 12. Plating solution enters the sparger shaft at 45, flows through the passage in the shaft and exits the shaft at **45*a*, and enters between the two halves 32 and 33** of the feed sparger.

Two halves 34 and 35 of the return sparger are rigidly mounted on sparger shaft 39 and positioned such that the two halves 32 and 33 of the feed sparger are in between the two halves 34 and 35 of the return sparger. Positioned on each side of the return spargers are wheel plates 37 and 38. Wheel plates 37 and 38 are rotatably mounted on the sparger shaft.

Plating wheel 30 is ring shaped and is positioned over the feed (32 and 33) and return (34 and 35) spargers, and held in place by wheel plates 37 and 38. The plating wheel 30 has a plurality of openings, generally indicated at 48 and 50, extending through from the feed side indicated at 44 through to the side at which the lead frame strip 54 makes contact. The holes 48 and 50 are in a predefined pattern so that they expose lead frame strip contact fingers (not illustrated) that are to be plated. The holes limit the area of the lead frame strip exposed to plating solution to only those areas that are to be plated.

In operation, plating solution is pumped into sparger shaft 39 at inlet 45 flows through the shaft to opening 45*a*, and is forced, under pressure, through the anode 55 between the ends of the feed sparger halves as indicated at 44. The plating solution is forced against the bottom side of plating ring 30, and through holes 48 and 50, plating the exposed contact areas on lead frame strip 54. The plating solution is confined within the plating wheel assembly by belt 31. Excess plating solution is collected between return sparger halves 34 and 35 and feed sparger halves 32 and 33, and enters the sparger shaft plating solution return passage at 42 and 43. The used plating solution is removed from the plating wheel assembly and sparger shaft 39 at outlet 41, flowing in the direction indicated by arrow 46. The plating anode 55 in the feed sparger is electrically connected to wire 56. Steel shaft 57 in sparger shaft 39, is used as an electrical connection from a power source (not illustrated) to the plating assembly. An electrical wire and terminal 56 terminal is mounted on the sparger shaft 39, and extends into the sparger shaft to connect to the steel shaft 57. The electrical wire 56 is connected from the terminal to the feed sparger anode 55. The electrical connection between the terminal and the steel shaft is not illustrated in FIG. 2 because of the way the cross-section is taken. The lead frame material is the grounding connection for the plating current.

Rotation of plating wheel 30 is caused by the travel of the lead frame strip 54 and belt 31. As lead frame strip 54 and belt 31 are pulled around the plating wheel 30, plating wheel 30 is rotated. In the event that there is possibility of slippage or misregistration between the plating wheel 30 and the lead frame strip 54, index pins (not illustrated) may be mounted in the plating wheel at intervals to corresponding with index holes extending along one or both sides of the lead frame strip. Such index pins will give a positive rotation to the plating wheel 30 as the lead frame strip is pulled around the plating wheel assembly 11.

The sparger shaft, return sparger, wheel plates and part of the feed sparger may be of, for example, polyether-ether-ketone.

The plating wheel system assembly 11, is held on the sparger shaft 39 by retainer nut 52, and is spaced from the vertical mounting wall 12 by bushing 53.

A manifold (not illustrated) may be connected to the sparger shaft on the mounting plate 12 to provide the input and output port connections for the plating solution and the electrical connection to the steel shaft 59.

What is claimed:

1. A plating system for selectively plating ares of a continuous strip of material comprising:

a stationary mounting shaft;

a rotating plating wheel mounting on the stationery mounting shaft;

a plating solution feed sparger having two halves rigidly mounted on the mounting shaft inside the rotating plating wheel;

an anode joining the feed sparger halves, the plating solution passing through the anode;

a continuous belt in contact with the rotating plating wheel and moving synchronously therewith to contain the plating solution within the plating wheel.

2. The plating system according to claim 1, including a plating solution return sparger having two halves, one half on each side of the feed sparger.

3. The plating system according to claim 2 wherein used plating system is collected between the feed sparger and the return sparger.

4. The plating system according to claim 1, wherein the stationary mounting shaft has two channels central to the shaft, and a contact shaft, the first of said channels providing an inlet for introducing plating fluid into the feed sparger, a second of said channels for removing used plating fluid, and said contact shaft providing power to said anode.

5. The plating system according to claim 1, wherein a continuous strip of metal on which selected areas are to be plated is in contact with the plating wheel, and wherein the plating wheel has a pattern of holes therein corresponding to the selected areas to be plated on the continuous strip of metal.

6. The plating system according to claim 1, including a continuous strip of material having openings through the material and on which patterns are to be plated, wherein the continuous strip of material is moved between the plating wheel and the belt to prevent plating solution from flowing through openings in the continuous strip of material.

7. A plating system for selectively plating areas of a continuous strip of material comprising;

a stationary mounting shaft;

a rotating plating wheel mounted on the stationery mounting shaft;

a plating solution feed sparger having two halves rigidly mounted on the mounting shaft inside the rotating plating wheel;

an anode joining the feed sparger halves, the plating solution passing through the anode;

a metal shaft within the stationary mounting shaft for supplying D.C. current to the anode; and a continuous belt in contact with the rotating plating wheel and moving synchronously therewith to contain the plating solution within the plating wheel.

8. The plating system according to claim 7, including a plating solution return sparger having two halves, one half on each side of the feed sparger.

9. The plating system according to claim 8, wherein used plating system is collected between the feed sparger and the return sparger.

10. The plating system according to claim 7, wherein the stationary mounting shaft has two channels central to the shaft, and a contact shaft, the first of said channels providing an inlet for introducing plating fluid into the feed sparger, a second of said channels for removing used plating fluid, and said contact shaft providing power to said anode.

11. The plating system according to claim 7, wherein a continuous strip of metal on which selected areas are to be plated is in contact with the plating wheel, and wherein the plating wheel has a pattern of holes therein corresponding to the selected areas to be plated on the continuous strip of metal.

12. The plating system according to claim 7, including a continuous strip of material having openings through the material and on which patterns are to be plated, wherein the continuous strip of material is moved between the plating wheel and the belt to prevent plating solution from flowing through openings in the continuous strip of material.

* * * * *